US012773090B2

(12) United States Patent
Kojanis

(10) Patent No.: US 12,773,090 B2
(45) Date of Patent: Oct. 27, 2026

(54) CLEANING DEVICE

(71) Applicant: Lee Kojanis, New York, NY (US)

(72) Inventor: Lee Kojanis, New York, NY (US)

( * ) Notice: Subject to any disclaimer, the term of this patent is extended or adjusted under 35 U.S.C. 154(b) by 239 days.

(21) Appl. No.: 18/488,941

(22) Filed: Oct. 17, 2023

(65) Prior Publication Data

US 2025/0120567 A1 Apr. 17, 2025

(51) Int. Cl.
*A47L 13/12* (2006.01)
*A47L 17/00* (2006.01)
*A47L 13/16* (2006.01)

(52) U.S. Cl.
CPC ..... *A47L 17/00* (2013.01); *A47L 13/12* (2013.01); *A47L 13/16* (2013.01)

(58) Field of Classification Search
CPC ..... A47L 13/12; A47L 13/16; A47L 17/00; A46B 9/02; A47K 7/02
See application file for complete search history.

(56) References Cited

U.S. PATENT DOCUMENTS 2,052,337 A * 8/1936 Alefantis ..... A47K 7/02 15/244.3
2,229,071 A * 1/1941 Godstrey ..... D06F 53/005 68/241
2,700,787 A * 2/1955 Trapanese ..... A01K 97/16 15/210.1
3,135,003 A 6/1964 Wise
3,317,944 A * 5/1967 Napier ..... B05C 17/00 15/244.1
3,694,845 A 10/1972 Engelsher
4,517,702 A * 5/1985 Jackson ..... A61B 1/122 401/9
4,811,448 A 3/1989 Yagi
5,214,820 A * 6/1993 Shumway ..... A47L 13/12 15/118
6,298,515 B1 10/2001 Robinson
6,485,822 B1 * 11/2002 Osiecki ..... B32B 5/18 15/244.4
7,124,465 B1 * 10/2006 Kaminstein ..... A47L 13/16 15/244.4
8,001,645 B2 * 8/2011 Kaufman ..... B08B 1/12 15/244.4
2001/0029967 A1 * 10/2001 McDonough ..... A47L 13/16 15/244.4
2013/0091648 A1 * 4/2013 Frigo, Jr. ..... A47L 13/12 15/244.4
2014/0075699 A1 * 3/2014 Krause ..... A47K 7/02 15/209.1

(Continued)

FOREIGN PATENT DOCUMENTS

DE 202017004575 U1 * 11/2017 ..... A47K 7/02
JP H10323212 A * 12/1998

*Primary Examiner* — Michael D Jennings

(57) ABSTRACT

The present invention generally relates to a cleaning device for cleaning the inside and outside of a container, typically glassware. The cleaning device cleans from an open end of the container and includes a compressible oval shaped body with a lower section separating into a first jaw and a second jaw. The upper section of the body includes finger slots extending into each jaw to allow the user access to the interior for easy operation. The following allows one jaw to clean the outside of the container while the other jaw cleans the inside the container in one simultaneous movement.

9 Claims, 5 Drawing Sheets

(56) References Cited

U.S. PATENT DOCUMENTS

| | | | | |
|---|---|---|---|---|
| 2015/0034122 | A1* | 2/2015 | Mottola | A61B 90/80<br>15/104.001 |
| 2020/0100641 | A1* | 4/2020 | Konkey | A47L 13/16 |
| 2021/0196096 | A1* | 7/2021 | Fromm | A47L 25/005 |

* cited by examiner

CLEANING DEVICE

FIELD OF THE INVENTION

The invention relates to a device for cleaning drinking containers, such as glassware. Containers for wine and cocktails tend to be made of delicate glass and are thus more expensive. The thin delicate nature of these containers is better for the aromatics of the wine or cocktails but not for the durability of the glass itself. Thus, much of this glassware needs to be polished and cannot be placed in a conventional dishwasher and must be handwashed. Dishwashers often leave soap residue or worse applies too much pressure and vibration ultimately breaking the glass. Commonly known hand washing cleaning devices usually comprise paper towels, household rags, sponge, a cleaning glove, rigid structures with inner and outer cleaning aids usually a sponge or bristles, or cleaning aids attached to rigid handles. Such cleaning devices are used in e.g. kitchens, bars and restaurants to clean the inside and outside of a glass in a manual operation. In a cleaning operation, the glass is pressed against the cleaning apparatus, and is moved up and down while being rotated.

In operation these devices suffer from poor coverage as it might take multiple sweeps of the device to clean hard to reach spots. In particular, regular sponges, rags, and paper towels have to be bent into shape for cleaning and often cannot reach the bottom of the container and require several passes that could lead to wear or even damage of the container. Additionally, none of these devices provide adequate cushioning between the user's finger and the container to be cleaned, and if cushioning is there, such as a thick sponge, it imparts a complete lack of dexterity and feel needed. Thus, leading to the user exerting too much pressure on a container leading to possible chipping or shattering due to the thin glassware.

Purpose built devices for cleaning glassware also suffer from similar setbacks. For example, UP U.S. Pat. No. 4,811,448 discloses a device with rigid structures supporting inner and outer cleaning sponges. This device is limited though. Despite providing simultaneous cleaning on the inside and outside the glass, the device requires a particular type of glass to operate effectively and cannot adapt readily to other sizes. Furthermore, the rigid structures found therein may form pressure points that could lead to inadvertent chipping or shattering of the glassware. Thus, a device is needed imparting higher adaptability to different types of glassware while allowing the user to vary the pressure applied thereto.

Additionally, devices with sponges or cleaning aids at the end of handles or sticks as disclosed in U.S. Pat. No. 6,298,515 while may help when reaching hard to clean spots within the container. Unfortunately, the risk is increased that the user may inadvertently apply too much pressure to the handle or grip damaging the container it set out to clean, since the user loses all dexterity and feel during the cleaning process. Thus, the cleaning device of this application aims at providing a device for cleaning drinking glasses that is of simple design and operation, yet with which more persistent stains and dirt may be removed reliably with less pressure maintaining the structural integrity of the container to be cleaned.

SUMMARY OF THE INVENTION

In view of the foregoing disadvantages inherent in the known types of container cleaning devices now present in the prior art, the present invention provides an improved cleaning device for cleaning the inside and outside of a container simultaneously. The containers are usually made of glass and are often prone to shattering. Therefore, the cleaning device was designed to conform to the container while also providing enhanced feel for the user to prevent breaking and improving the cleaning coverage of the walls of the container.

In the preferred embodiment, the cleaning device includes a generally oval shaped body. The body is made from a compressible sponge-like material such as an open cell polyurethane or the like. Polyurethane foam is especially advantageous due to its resistance to abrasion and tearing. The cleaning device can be manufactured using a die cutting process with CNC machining for rounding the edges. Additionally, 3-D printing and injection molding manufacturing may be employed due to the high detail found in these processes, and easy repeatability that produces low waste.

The body of the cleaning device includes an upper section and a lower section. At the lower section the body diverges into two opposing jaws separated by an angle. The upper section includes a first and a second slot which extends into the interior of the body, and into the first and the second jaw respectively. These slots allow the user to place their fingers into the device providing for additional control when undergoing the cleaning process. The slots may include a surface treatment including lining the inside surface of the slots with a water repellent coating to increase rigidity and durability of the slots during repeated use; for example, vinyl and silicone coatings have performed well for this purpose. The outside edges of the body are rounded, thus providing for a smooth surface to move across the interior and exterior of the container preventing bunching and increasing the coverage the device can reach within the container to be cleaned.

In operation the user first wets the body, soaking up water and adding soap therein. The user then puts two fingers into the slots on the top end of the cleaning device, usually the thumb and index finger, and holds a glass or container with the other free hand. The user then inserts one of the two jaws into the inside of the container and one on the outside of the container until the rim of the glass meets the intersection of the two jaws. Once fully inserted the user applies gentle pressure within the finger slots ensuring good contact between the compressible body and the container. Then the user wipes around the glass simultaneously cleaning the inside and outside of the container.

Thus, the device according to the present invention is easy to use and the danger of damaging the container is minimized. The risk of the user being injured is also minimized accordingly, and the efficiency of the cleaning work is improved. Further, the cleaning device according to the present invention is simple and easily manufactured with little cost.

BRIEF DESCRIPTION OF DRAWINGS

The following drawings are submitted with this utility patent application.

DETAILED DESCRIPTION

Figure 1:
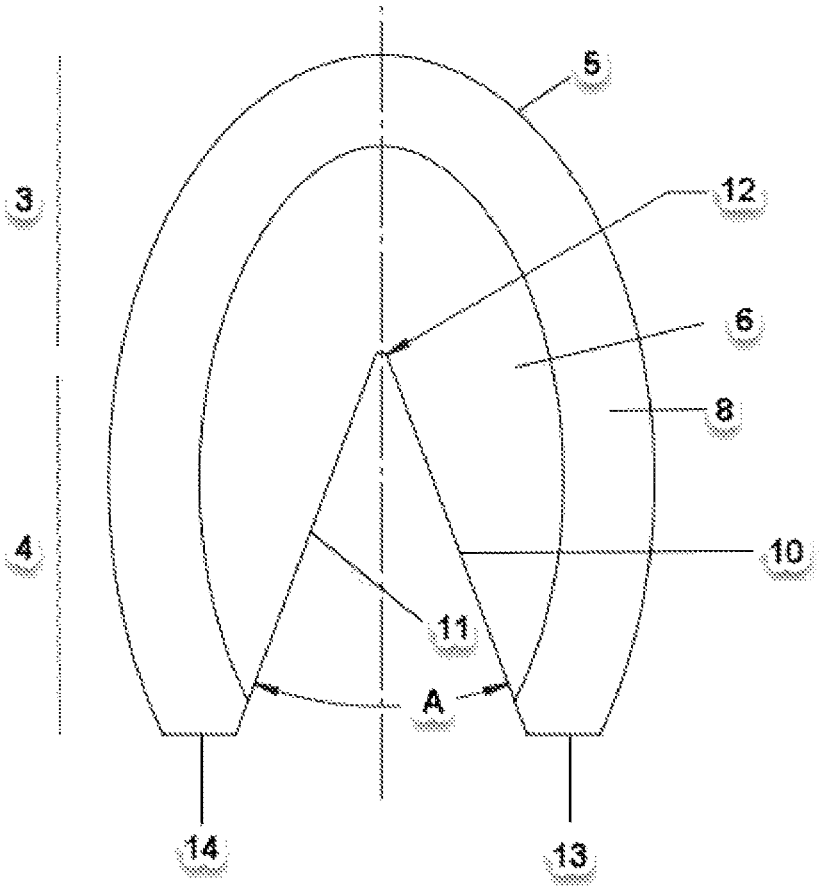
FIG. 1 is a front view of the invention.
Figure 2:
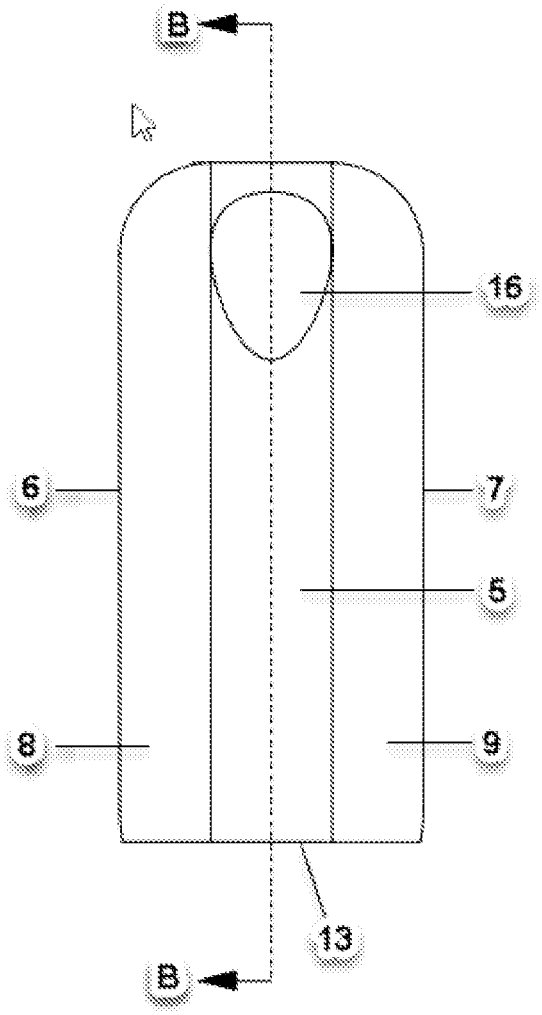
FIG. 2 is a side view of the invention.

The invention, as shown in FIGS. 1-6 of the drawings, is a sponge-like cleaning device 1 comprising an integral body 2, however a layering of materials may be employed to vary the compressibility of the body. The body 2 is made from a flexible compressible material and including generally an oval shaped perimeter surface 5. The body includes first side surface 6 and a second side surface 7. The first side surface 6 and second side surface 7 are generally flat for resting the device. As seen in FIG. 2, the first side surface 6 and the second side surface 7 meet the perimeter surface 5 along a first rounded edge 8 and a second rounded edge 9 respectively. The first rounded edge 8 and the second rounded edge 9 follow the same oval-like shape as the perimeter surface. The first rounded edge 8 and the second rounded edge 9 can be made via a CNC machining process providing the smooth rounded surface.

The perimeter surface 5 of the body extends around the body between an upper section 3 and a lower section 4 as seen in FIG. 1. The lower section of the body diverges into a first jaw 10 and a second jaw 11 separated by an angle A. It has been found that an angle in the range of 30 to 50 degrees provides sufficient clearance between the first and second jaw to be placed on the rim of the container, or more preferably an angle between 35 degrees to 45 degrees. The first jaw 10 and the second jaw 11 meet at an intersection 12 in the upper section 3 providing a resting point for the container rim during cleaning. The lower section 4 further includes a first resting surface 13 and second resting surface 14 at the end of the first jaw 10 and the second jaw 11 respectively, these surfaces are generally flat allowing the user to rest the device upright on a counter or table.

Figure 3:
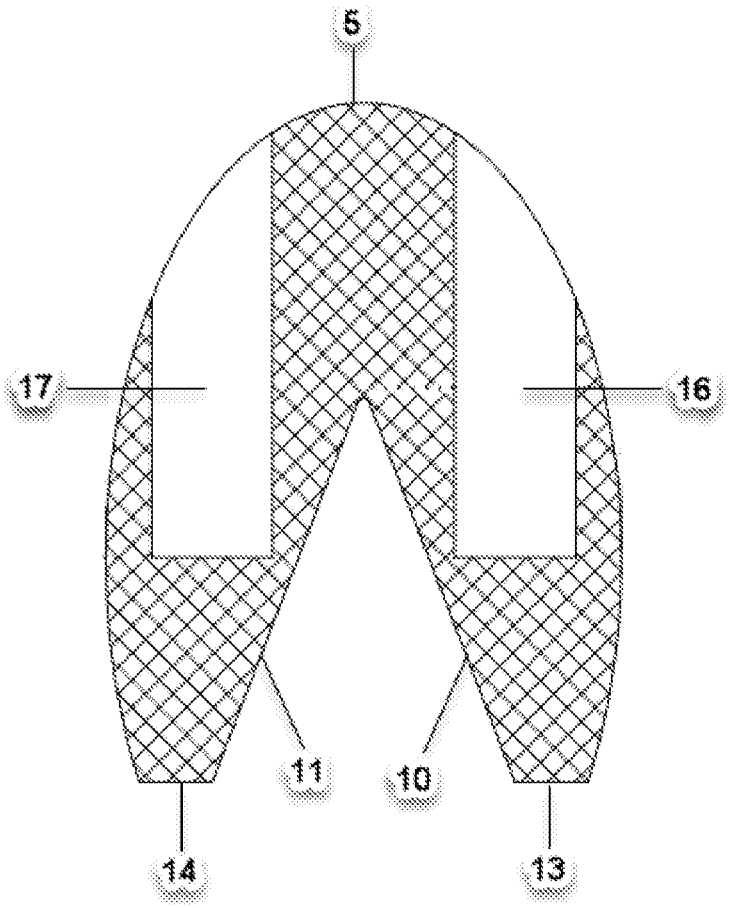
FIG. 3 is a cross sectional view taken along the line B-B in FIG. 2
Figure 4:
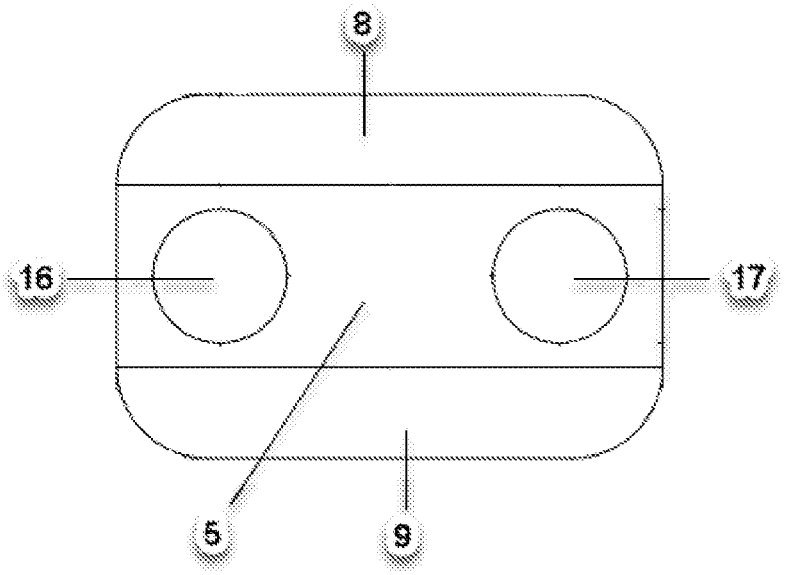
FIG. 4 is a top view of the invention.
Figure 5:
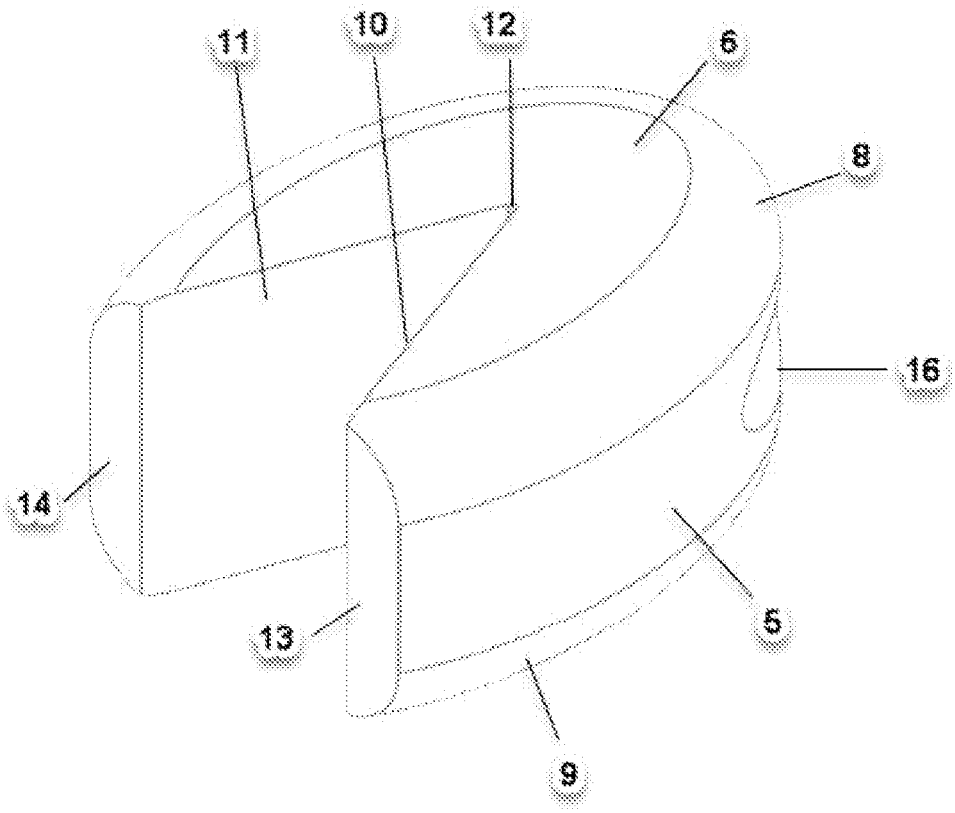
FIG. 5 is the bottom perspective view.

As seen in FIG. 3-4, a first slot 16 and a second slot 17 are disposed along the perimeter surface 5 in the upper section 3. The first slot 16 and the second slot 17 extend into the interior of the body 2, and into the first jaw 10 and the second jaw 11 respectively. The first slot 16 and the second slot 17 provide the user spaces to insert his or her fingers to move the first and the second jaw in/out toward each other to apply varying pressure to the wall of the container when performing the cleaning operation. Additionally, the first slot 16 and the second slot 17 may include a surface treatment including lining the inside surface of the slots with a water repellent coating such as vinyl and silicone to increase rigidity and durability of the slots during repeated use. The first slot (16) and the second slot (17) being cylindrical blinds holes.

In operation the user first wets the body 2, soaking up water and adding soap therein. The user then puts two fingers into the first slot 16 and the second slot 17 on the top end of the cleaning device, usually the thumb and index finger, and holds a container typically made of glass with the other free hand. The user then inserts one of the first jaw 10 and the second jaw 11 into the inside of the container and the other of the first jaw 10 and the second jaw 11 on the outside of the container until the rim of the glass meets at the intersection 12 of the two jaws. Once fully inserted the user using her fingers pinches with gentle pressure from within the first slot 16 and the second slot 17 ensuring good contact between the compressible body 2 and the container. Then the user wipes around the container simultaneously cleaning the inside and outside of the container. Once the user has finished cleaning, the cleaning device is rinsed off for use with another container or for storage.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, although the body is depicted as an oval-like shape, other shapes may be implemented including but not limited to circular, angular, triangular, etc. If the shape converges into a lower section including two jaw-like features for forming around the rim of a container, the shape may be implemented.

While the invention has been described in detail and with reference to specific embodiment thereof, it will be apparent to one skilled in the art that various changes and modifications can be made therein without departing from the spirit and scope thereof.

The invention claimed is:

1. A cleaning device for cleaning a container comprising:

a. a body formed from a compressible material, b. the body including an upper section, a lower section, and a perimeter surface extending from the upper section into the lower section;

c. the lower section includes a first jaw and a second jaw;

e. the upper section includes a first slot extending from the perimeter into the first jaw and a second slot extending from the perimeter into the second jaw; and f. wherein the first slot and the second slot being cylindrical blind holes.

2. The cleaning device as claimed in claim 1, wherein the body is generally oval shaped.

3. The clean device as claimed in claim 1, the first jaw and the second jaw extend at an angle from each other from an intersection in the upper section into the lower section.

4. The cleaning device as claimed in claim 3, wherein the angle is in a range from 35 degrees to 45 degrees.

5. The cleaning device as claimed in claim 1, wherein the compressible material is a polyurethane foam.

6. The cleaning device as claimed in claim 1, wherein the first jaw and the second jaw include lower end flat surfaces for resting on a counter.

7. The cleaning device as claimed in claim 1, wherein the perimeter surface includes rounded outside edges.

8. The cleaning device as claimed in claim 1, wherein the body is integral.

9. The cleaning device as claimed in claim 1, wherein the first slot and the second slot are surface treated with one of silicone or vinyl.

* * * * *